United States Patent [19]

Obara et al.

[11] 3,950,166

[45] Apr. 13, 1976

[54] PROCESS FOR PRODUCING A SINTERED ARTICLE OF A TITANIUM ALLOY

[75] Inventors: Kunio Obara, Urawa; Yoshio Nishino; Shoji Matsumoto, both of Omiya, all of Japan

[73] Assignee: Mitsubishi Metal Corporation, Tokyo, Japan

[22] Filed: Jan. 30, 1974

[21] Appl. No.: 437,902

[30] Foreign Application Priority Data

Feb. 7, 1973 Japan ..... 48-14606

[52] U.S. Cl. ..... 75/213; 29/182; 75/200; 75/221; 75/224

[51] Int. Cl.[2] ..... B22F 3/16

[58] Field of Search ..... 75/213, 221, 224, 200; 29/182

[56] References Cited

UNITED STATES PATENTS

| | | | |
|---|---|---|---|
| 2,163,224 | 10/1937 | Alexander | 75/221 |
| 2,246,387 | 6/1941 | Schwarzkoff | 75/221 X |
| 3,084,042 | 2/1963 | Wartel et al. | 75/221 |
| 3,175,903 | 3/1965 | Herron | 75/221 X |
| 3,496,036 | 2/1970 | DiGiambattista | 75/213 X |
| 3,847,603 | 11/1974 | Fukuda et al. | 75/221 X |
| 3,859,087 | 1/1975 | Backstrom | 75/221 X |

FOREIGN PATENTS OR APPLICATIONS

| | | |
|---|---|---|
| 887,922 | 1/1964 | United Kingdom |

OTHER PUBLICATIONS

Abkowitz; S., "Titanium Science and Technology", Vol. I, Plenum Press Proceedings of 2nd Int. Conf. on Ti P/M Preforms, 1972.

Friedman; G. I., "Modern Developments in Powder Met.", Vol. V, Plenum Press, Proc. of Int. Powd. Met. Conf. 1970.

*Primary Examiner*—Benjamin R. Padgett
*Assistant Examiner*—Richard E. Schafer
*Attorney, Agent, or Firm*—Flynn & Frishauf

[57] ABSTRACT

A sintered article of a titanium alloy is produced by powder metallurgy techniques, the alloy having uniform structure, and improved mechanical properties, machinability and weldability. The process comprises; partially sintering a powder mixture of (a) at least one selected from the group consisting of powdered titanium and titanium hydride having a particle size of minus 60 mesh and (b) at least one powdered additive selected from the group consisting of powdered Ni, Al, Cu, Sn, Pd, Co, Fe, Cr, Mn, and Si having a particle size of minus 60 mesh, to partially alloy the titanium with one or more additives employed; after furnace cooling the partially sintered mass to room temperature, pulverizing it to powder of minus 60 mesh in particle size to prepare mother alloy powder; mixing (a) the mother alloy powder having a particle size of minus 60 mesh, (b) at least one selected from the group consisting of powdered titanium and titanium hydride having a particle size of minus 60 mesh, and (c), if necessary, at least one additional element selected from the group consisting of powdered V, Mo, Zr and Al-V alloy, which are added for the purpose of avoiding excess formation of a liquid phase during the subsequent sintering; compacting the thus formed powder mixture into a compact having a predetermined shape; and sintering the compact at a temperature ranging from 1000°C to 1500°C in a non-oxidizing and non-nitriding atmosphere for from 30 minutes to 2 hours.

16 Claims, 2 Drawing Figures

X500

PROCESS FOR PRODUCING A SINTERED ARTICLE OF A TITANIUM ALLOY

Figure 1:
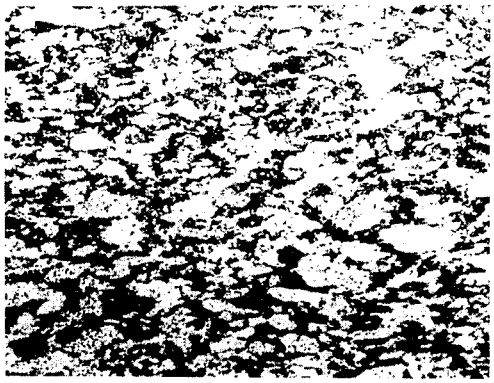
Fig. 1 PRIOR ART

The present invention relates to a process for producing a sintered article of a titanium alloy by powder metallurgy techniques, said alloy having uniform structure, and improved mechanical properties, machinability and weldability.

Titanium alloys have been known to have good resistance to corrosion, oxidation and wear, as well as improved specific strength (strength/density).

In the prior art, articles of titanium alloys have been produced either with melting processes or with powder metallurgy techniques. However, the prior art techniques are not satisfactory.

The melting processes generally comprise the steps of: forming a consumable electrode comprising various metals in addition to sponge titanium; vacuum arc melting the electrode several times so as to alloy the titanium with the metals added; subjecting the solid alloy to hot working, such as extrusion, forging, etc., to prepare a rod of the alloy; and subjecting a blank suitably cut from the rod to die forging to provide a final product having a predetermined shape.

The melting processes essentially requires many and complex working steps, some of which must be repeated several times, because not only titanium easily reacts with oxygen in air, but also because titanium is hard to work (of less workability). In addition, because it is difficult to work it in a single step, not only must the working of work pieces be repeated several times, but also annealing treatment for pieces worked must be introduced every time prior to the next working step. Thus, a long period of time is required with the prior art melting processes to complete the final products. Also, yields are remarkably low. Further, the melting processes additionally require the steps of trimming and pickling, if the products are to be finished by hot working. Accordingly, when a melting process is used to produce small sized articles of complex shape, the production cost is rather great.

Hitherto, several powder metallurgy techniques have been proposed to eliminate the above disadvantages of the melt processes, all of which involve simplifying the process steps. The following three kinds of processes are typical: (1) one process comprises the steps of: mixing powdered titanium and additive metals, compacting the resulting powder mixture to provide a compact, and sintering the compact; (2) another process comprises the steps of: preparing powder of a mother alloy, such as Ti-Al system alloys, by means of a melt-graining method or atomization, mixing powdered titanium with the mother alloy powder, compacting the resulting powder mixture to provide a compact, and sintering the compact; and (3) another process comprises the steps of: preparing alloy powder having desired composition by means of a rotating electrode method and compacting and sintering the alloy powder.

However, it is inherent in the first process above that excess formation of a liquid phase cannot essentially be prevented due to its nature. In addition, it is difficult to precisely control the composition of the final sintered compact, because either too much of the additive metals evaporates during the conventional vacuum sintering, particularly when relatively low melting point metals are used as additive metals, or the additive metals form a eutectic compositon solution with titanium. In such a case, remarkable damages of furnace materials are also observed. Excess formation of a liquid phase during sintering brings about the formation of relatively large pores in the sintered body, resulting in growth of the compact (relatively bulky compact). It is, therefore, difficult to compact the sintered body to a density close to the theoretical density.

The second process above is inherently costly, and highly skilled technicians are required for the melting operations used in the production of mother alloys. In this respect, this process has the same disadvantages as the first mentioned melting process. Lastly, chemical composition desired in the final Ti-alloys sometimes limits the application of this method.

In the third process in the above, it is necessary to rotate the electrode in a vacuum at high speed; the mechanism required for this is complicated and costly. Further, the thus obtained particles are roughly spherical shape (called hard powder), and it is impossible to compact such particles sufficiently with conventional techniques.

It has now been found that excess formation of a liquid phase may successfully be eliminated by employing a powder mixture which contains powdered titanium material and mother alloy powder which has been prepared by partially sintering a starting powder material of powdered titanium and one or more alloying elements and pulverizing the resulting partially sintered bulk material prior to the sintering of compacts.

Thus, an object of the present invention is to provide a simple process for producing sintered articles of titanium alloys which have uniform structure, improved mechanical properties, good machinability and weldability.

Another object of the present invention is to provide a powder metallurgy technique, which will hereinafter be called two-stage sintering process, in order to produce the articles.

Therefore, the present invention provides a two-stage process to establish the above objects.

The present invention relates to a process for producing an article of a titanium alloy by powder metallurgy techniques comprising a first sintering stage in combination with a second sintering stage, in which said first sintering stage comprises the steps of: mixing at least one material selected from the group consisting of powdered titanium and titanium hydride, and at least one powdered additive to provide a powder mixture, sintering the powder mixture to partially alloy the titanium with the additive, pulverizing the partially sintered mass to prepare a mother alloy powder; and said second sintering stage comprises the steps of: mixing said mother alloy powder with at least one material selected from the group consisting of powdered titanium and titanium hydride to provide a powder mixture having predetermined composition, compacting the powder mixture into a compact having a predetermined shape, and sintering the compact to provide the titanium alloy article.

Particularly, the present invention relates to a process for producing the titanium alloy articles, which comprises a first sintering stage in combination with a second sintering stage, said first sintering stage comprising the steps of partially sintering a mixture of about 20 – 90 percent by weight of at least one material selected from the group consisting of powdered titanium and titanium hydride having a particle size of at least minus 60 mesh, and about 10 – 80 percent by weight of at least one powdered additive selected from the group consisting of powdered Ni, Al, Cu, Sn, Pd, Co, Fe, Cr, Mn and Si having a particle size of at least minus 60 mesh to provide a partially alloyed mass, which is, after being cooled to room temperature, pulverized so as to prepare a mother alloy powder; and said second sintering stage comprising the steps of mixing at least one material selected from the group consisting of powdered titanium and titanium hydride having a particle size of at least minus 60 mesh with said mother alloy powder in an amount to make the additive content in the range of 0.2 – 40 percent by weight of the total weight of the final sintered compact, compacting the powder mixture thus obtained into a compact having a desired shape and composition, and sintering the compact at conditions of temperature and pressure as well as atmosphere to bring about solution sintering.

If desired, the addition of at least one element selected from the group consisting of powdered V, Mo, Zr and Al-V alloys to the powder mixture of the second sintering stage is also advantageous to completely avoid excess formation of a liquid phase during the second sintering stage.

According to one preferred embodiment of the present invention, a process is provided, which comprises a first sintering stage in combination with a second sintering stage, said first sintering stage comprising partially sintering a powder mixture of about 20 –90 percent by weight of at least one material selected from the group consisting of powdered titanium and titanium hydride having a particle size of at least minus 60 mesh and about 10 – 80 percent by weight of at least one additive selected from the group consisting of powdered Ni, Al, Cu, Sn, Pd, Fe, Co, Cr, Mn and Si having a particle size of at least minus 60 mesh, said first sintering stage being carried out under conditions including a non-oxidizing and non-nitriding atmosphere, a temperature which is higher than the melting point of said additives selected and the eutectic point thereof with the titanium, and is not more 400° C higher than the above points, and a sintering period of from 10 minutes to 2 hours, to provide a partially alloyed mass, which is after being cooled to room temperature in the furnace, pulverized so as to prepare a mother alloy powder having a particle size of at least minus 60 mesh: said second sintering stage comprising the steps of mixing at least one material selected from the group consisting of powdered titanium and titanium hydride having a particle size of at least minus 60 mesh with said mother alloy powder in an amount to make the additive content in the range of 0.2 – 40 percent by weight of the total weight of the compact, compacting the thus obtained powder mixture, e.g. at a pressure of 4–8 T/cm$^2$ to form a compact having a predetermined shape and composition, and sintering the compact under the conditions including a non-oxidizing and non-nitriding atmosphere, such as vacuum of $10^{-4}$ Torr or less, an Ar atmosphere having a dew point of −50° C or less, a temperature ranging from 1000° C to 1500° C and a sintering period ranging from 30 minutes to 2 hours.

The titanium powder to be used in the present invention may be a commercially available one, the purity of which is generally in the range of 99.0 to 99.9 percent.

The preferred particle size of powdered titanium and titanium hydride to be supplied to the mother alloy production stage as well as the second sintering stage of the present invention may be about minus 60 mesh, since the coarser the particle is, the longer the period of time that is required to alloy the titanium with the additives selected. A satisfactory particle size is about minus 100 mesh, with the most preferred size being minus 200 to plus 300 mesh. Regarding the particle size of the additives, i.e. powdered Ni, Al, Cu, Sn, Pd, Co, Fe, Cr, Mn and Si, the same particle sizes are preferred for the same reason.

The content of the additives may be in the range of from 10 to 80 percent by weight of the powder mixture for the first sintering stage. Within this range the additives can easily react with the titanium particles to make an alloy. The powder mixture may contain at least 10 percent by weight of the additives, so as to prepare titanium mother alloys having the desired chemical composition. The higher additive content results in the less mixture to be treated. However, if the additive content is more than 80 percent by weight, a high temperature and a long sintering period are required so as to achieve uniform alloying of the additives with the titanium in the subsequent sintering stage. Thus, the upper limit is about 80 percent by weight. Generally, an additive content within the range of from 30 to 50 percent by weight is preferred.

The first sintering stage for producing the mother alloy powder is carried out in an atmosphere of vacuum of $10^{-4}$ Torr or less, or an Ar atmosphere having a dew point not more than −50° C. The atmosphere serves to prevent oxidizing and nitriding of the charge.

The temperature conditions may be determined so as to establish solution phase sintering, so that the temperature of the first sintering stage may be a temperature higher than the melting point of the additives and an eutectic point between the titanium and the additives employed. However, the sintering temperature should be limited to a temperature not more than 400° C higher than the above melting points and eutectic points, because excess formation of a liquid phase might be experienced upon heating the mixture to such a higher temperature. The excess formation of the liquid phase should be avoided, because it brings about large and hard particles, which are difficult to reduce to a desirable particle size. The preferred temperature in the first sintering stage may be a temperature more than 100° C higher than the melting points and the eutectic points, but not more than 400° C higher than the above temperatures. Generally, the temperature falls within the range of from 600° C to 1200° C. In addition, for the temperature of the second sintering stage, a temperature within the range of from 1000° C to 1500° C is preferable.

The sintering time for the partial alloying process of the first sintering stage of the present invention may be from about 10 minutes to 2 hours. For the second sintering stage, it may be from 30 minutes to 2 hours. With a higher temperature (i.e. close to the upper limit of the temperature range) the sintering time can be decreased. A man skilled in the art can easily determine suitable temperature conditions, considering the other operational conditions.

The mother alloy production of the present invention as defined in the above may result in a partially sintered mass in which the titanium particle is partially alloyed with the additives. The thus obtained mass of the mixture may easily be pulverized (reduced to powder having a particle size of minus 100 mesh, e.g. by means of a single treatment with a mixing and grinding machine).

As mentioned hereinbefore, excess formation of the liquid phase during the second sintering stage brings about the formation of large pores in the resulting sintered compact to increase its volume. This makes it impossible to compact it close to its theoretical density. In the present invention the partial sintering of the titanium-containing mixture in the first sintering stage avoids the formation of such excess liquid phase in the second sintering stage. The addition of at least one element selected from the group consisting of powdered V, Mo, Zr and Al-V alloys to the powder mixture of the second sintering stage may also help to avoid excess formation of the liquid phase.

Figure 2:
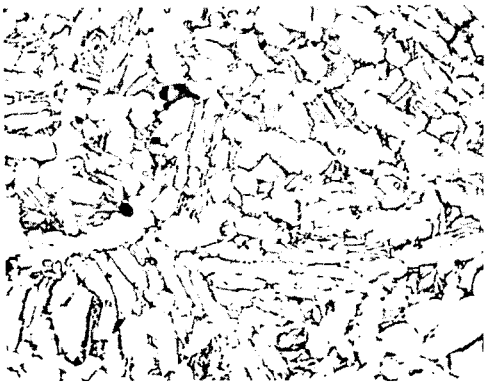

In the drawings, FIG. 1 is a microstructure ($x$500) of Ti-6Al-4V alloy produced by the prior art melting process, which was rolled and annealed at 750° C, and FIG. 2 is a microstructure at a magnification of 500 of Ti-6Al-4V alloy produced according to the present invention, which was further subjected to hot forging.

The present invention will be further described with reference to the following working examples, which are presented for the purpose of illustrating the invention, not limiting it.

EXAMPLE 1

Titanium powder of a particle size of minus 60 mesh and an equal volume of aluminum powder of a particle size of minus 200 mesh were mixed. The mixture was sintered at 800° C for 30 minutes in vacuum of $10^{-5}$ Torr to partially alloy the titanium with aluminum.

The thus obtained mother alloy was mechanically pulverized in a mixing and grinding machine to prepare mother alloy powder having a particle size of minus 100 mesh. To the mother alloy powder was added titanium powder having a particle size of minus 60 mesh in such amount as to make the aluminum content 5 percent by weight of the mixture. This powdery charge was compacted at the pressure of 5 T/cm$^2$ to form a compact, which was then sintered at 1200° C for 1 hour in vacuum of $10^{-4}$ Torr.

The density of this product was about 95 percent of theoretical density. The sintered compact body exhibited uniform microstructure, tensile strength of 50 kg/mm$^2$, elongation of 5 percent. The machinability of this sintered product could not be distinguished from that of pure titanium. Brightness of surface after tooling the sintered product of the present invention was superior to that observed in case of tooling a pure titanium specimen.

EXAMPLE 2

Titanium hydride powder having a particle size of minus 325 mesh and carbonyl nickel powder having a particle size of minus 325 mesh were mixed in such amount as to make the nickel content 30 percent by weight of the mixture. The resulting mixture was sintered at 1000° C for 30 minutes in an Ar atmosphere having a dew point of about −65° C to partially alloy the titanium with the nickel.

The thus obtained mother alloy sintered mass was pulverized in a mixing and grinding machine to prepare a mother alloy powder having a particle size of minus 200 mesh. To the mother alloy powder was added titanium hydride powder having a particle size of minus 325 mesh in such amount as to make the nickel content 10 percent by weight of the mixture. This powdery charge was compacted at a pressure of 7 T/cm$^2$ to provide a compact, which was then sintered at 1300° C for 1 hour in an Ar atmosphere having a dew point of −65° C.

The density of this product was 98 percent of theoretical density. The sintered compact body exhibited uniform microstructure, tensile strength of 60 kg/mm$^2$, and elongation of 3 percent. When the products were welded by means of TIG welding, X-ray analysis did not show any defect.

EXAMPLE 3

The Ti-Al system mother alloy powder obtained with an the same process as in Example 1 was admixed with Al-V system alloy powder (V 50 percent) having a particle size of minus 200 mesh as well as titanium powder having a particle size of minus 200 mesh to prepare a powdery charge having the composition of Al 4%, V 4% and Ti the rest. The Al-V system alloy powder was added for the purpose of completely eliminating the excess formation of a liquid phase during the subsequent sintering operation. The powdery charge was compacted at a pressure of 5 T/cm$^2$ to provide a compact body, which was then sintered at 1250° C for 1 hour in vacuum of $10^{-5}$ Torr. The resulting sintered product was further subjected to hot forging at 800° C to provide an article having a density of 99.5% of theoretical density. The final sintered product thus produced according to the present invention exhibited a tensile strength of 95 kg/mm$^2$ and an elongation of 10%.

EXAMPLE 4

A powder mixture having the composition of Al 40%, Sn 20% and Ti the rest was sintered at 600° C for 20 minutes in an Ar atmosphere having a dew point of −50° C to partially alloy the above constituents. The partially alloyed mass was pulverized to prepare a mother alloy powder having a particle size of minus 100 mesh. To the mother alloy powder was added titanium powder having a particle size of minus 60 mesh in an amount to give a composition of Al 5%, Sn 2.5% and Ti the rest. This powdery charge was compacted at a pressure of 4 T/cm$^2$ to provide a compact, which was then sintered at 1200° C for 1 hour in an Ar atmosphere having a dew point of −50° C. The sintered product was further subjected to hot forging, resulting in a final product having a density of 99.8% of theoretical density. The tensile strength of this product was 85 kg/mm$^2$ and elongation thereof is 15 percent.

FIG. 2 of the accompanying drawings shows the microstructure of the resulting alloy (Ti-6Al-4V), in which the white area is $\alpha$-titanium, and the black area is $\beta$-titanium. If one compares FIG. 2 with FIG. 1, which shows the microstructure of Ti-6Al-4V alloy produced by a melting process of the prior art, it is clear that the simple manufacturing process of the present invention provides a titanium alloy, the microstructure of which is not inferior to that of the alloy produced by the prior art melting process.

As described hereinbefore, according to the present invention, titanium alloy articles having a greater density, e.g. 85–98 percent of theoretical density can be produced by a very simple manufacturing process. In addition, the articles produced by the present invention can exhibit remarkable corrosion and wear resistant properties as well as excellent resistance to oxidation.

Further, the articles of the present invention exhibit good weldability and excellent mechanical properties.

If the articles of the present invention are forged under hot, warm or cold conditions, the products exhibit density closer to theoretical density, and further-improved mechanical properties.

What is claimed is:

1. A process for producing an article of a titanium alloy by powder metallurgy techniques, comprising a first sintering stage in combination with a second sintering stage, in which said first sintering stage comprises the steps of: mixing at least one material selected from the group consisting of powdered titanium and titanium hydride and at least one powdered additive to provide a first powder mixture, sintering the first powder mixture at a temperature not more than 400° C. higher than the melting point of the additive and the eutectic point of the additive with titanium to partially alloy the titanium with the additive, and reducing in size the partically sintered mass to prepare a mother alloy powder; and said second sintering stage comprises the steps of: mixing said mother alloy powder with at least one material selected from the group consisting of powdered titanium and titanium hydride to provide a second powder mixture having a predetermined composition, compacting the second powder mixture to form a compact having a predetermined shape, and sintering the compact to provide the article of a titanium alloy.

2. A process according to claim 1, in which the purity of the titanium used is in the range of from 99.0 percent to 99.9 percent.

3. A process according to claim 1, in which said first powder mixture for the first sintering stage comprises 20–90 percent by weight of at least one material selected from the group consisting of powdered titanium and titanium hydride having a particle size of at least minus 60 mesh, and 10-80% by weight of at least one powdered additive selected from the group consisting of powdered Ni, Al, Cu, Pd, Fe, Co, Cr, Mn and Si having a particle size of at least minus 60 mesh, said second powder mixture for the second sintering stage comprises said mother alloy powder having a particle size of at least minus 60 mesh and at least one material selected from the group consisting of powdered titanium and titanium hydride having a particle size of at least minus 60 mesh in an amount to make the additive content in the range of from 0.2 to 40 percent by weight of the total weight of the compact.

4. A process according to claim 3, in which the particle size of the powdery charge for each of the sintering stages is at least minus 100 mesh.

5. A process according to claim 3, in which the sintering of the first stage is carried out under conditions including a non-oxidizing and non-nitriding atmosphere, and a sintering period of from 10 minutes to 2 hours, and the sintering of the second stage is carried out under conditions including a non-oxidizing and non-nitriding atmosphere, a temperature ranging from 1000° C to 1500° C and a sintering time ranging from 30 minutes to 2 hours.

6. A process according to claim 3, in which the atmosphere for both sintering stages is a vacuum not more than $10^{-4}$ Torr.

7. A process according to claim 3, in which the atmosphere for both sintering stages is an Ar atmosphere having a dew point of not more than −50° C.

8. A process according to claim 3, in which the compacting pressure used for the second sintering stage is in the range of from 4 to 8 T/cm$^2$.

9. A process for producing an article of a titanium alloy by powder metallurgy techniques comprising a first sintering stage in combination with a second sintering stage, in which said first sintering stage comprises the steps of: mixing 20–90 percent by weight of at least one material selected from the group consisting of powdered titanium and titanium hydride and 10–80 percent by weight of at least one powdered additive selected from the group consisting of powdered Ni, Al, Cu, Sn, Pd, Fe, Co, Cr, Mn and Si to provide a first powder mixture, sintering the first powder mixture at a temperature no more than 400° C. higher than the melting point of the additive and the eutectic point of the additive with titanium to partially alloy the titanium with the additive, and reducing in size the partially sintered mass to prepare a mother alloy powder; and said second sintering stage comprises the steps of: mixing said mother alloy powder with at least one material selected from the group consisting of powdered titanium and titanium hydride, and at least one material selected from the group consisting of powdered V, Mo, Zr and Al-V alloy to provide a second powder mixture, the additive content of which is in the range of from 0.2 to 40 percent by weight of the total weight of the mixture, compacting the second powder mixture to form a compact having a predetermined shape, and sintering the compact to provide the article of a titanium alloy.

10. A process according to claim 9, in which the purity of the titanium used is in the range of from 99.0 percent to 99.9 percent.

11. A process according to claim 9, the particle size of the powdery charge for each of the sintering stages is at least minus 100 mesh.

12. A process according to claim 9, in which the sintering of said first sintering stage is carried out under conditions including a non-oxidizing and non-nitriding atmosphere, and a sintering time of from 10 minutes to 2 hours, and the sintering of said second sintering stage is carried out under conditions including a non-oxidizing and non-nitriding atmosphere, a temperature ranging from 1000° C to 1500° C and a sintering period ranging from 30 minutes to 2 hours.

13. A process according to claim 9, in which the atmosphere for both sintering stages is a vacuum of not more than $10^{-4}$ Torr.

14. A process according to claim 9, in which the atmosphere for both sintering stages is an Ar atmosphere having a dew point of not more than −50° C.

15. A process according to claim 3, in which the particle size of the powdery charge for each of the sintering stages is at least minus 200 mesh.

16. A process according to claim 9, in which the particle size of the powdery charge for each of the sintering stages is at least minus 200 mesh.

* * * * *